US010435864B2

(12) United States Patent
Holman

(10) Patent No.: US 10,435,864 B2
(45) Date of Patent: Oct. 8, 2019

(54) PLOW ASSEMBLY WITH VALVE SYSTEM FOR WINGS

(71) Applicant: STONEBROOKE EQUIPMENT INC., Burnsville, MN (US)

(72) Inventor: Jerry D. Holman, Lakeville, MN (US)

(73) Assignee: STONEBROOKE EQUIPMENT INC., Burnsville, MN (US)

( * ) Notice: Subject to any disclaimer, the term of this patent is extended or adjusted under 35 U.S.C. 154(b) by 188 days.

(21) Appl. No.: 15/414,941

(22) Filed: Jan. 25, 2017

(65) Prior Publication Data

US 2017/0218597 A1 Aug. 3, 2017

Related U.S. Application Data

(60) Provisional application No. 62/289,444, filed on Feb. 1, 2016.

(51) Int. Cl.

| | |
|---|---|
| ***E01H 5/06*** | (2006.01) |
| ***E02F 3/84*** | (2006.01) |
| ***E01C 23/08*** | (2006.01) |
| ***E01C 23/12*** | (2006.01) |
| ***E02F 3/413*** | (2006.01) |
| ***E02F 3/76*** | (2006.01) |

(Continued)

(52) U.S. Cl.

CPC ..... *E02F 3/844* (2013.01); *E01C 19/15* (2013.01); *E01C 23/08* (2013.01); *E01C 23/12* (2013.01); *E01H 5/061* (2013.01); *E01H 5/066* (2013.01); *E02F 3/413* (2013.01); *E02F 3/7613* (2013.01); *E02F 3/7618* (2013.01); *E02F 3/961* (2013.01); *E02F 3/96* (2013.01)

(58) Field of Classification Search

CPC ..... E01H 5/06; E01H 5/065; E01H 5/063; E01H 5/067; E01H 5/062; E01H 5/066; E01H 5/061; E02F 3/815; E02F 3/8155; E02F 3/844; E02F 3/413; E02F 3/7613; E02F 3/961; E01C 23/08; E01C 23/12; E01C 19/15

USPC ..... 37/281, 279, 244, 283, 466; 172/782, 172/815

See application file for complete search history.

(56) References Cited

U.S. PATENT DOCUMENTS

| | | | |
|---|---|---|---|
| 1,383,409 | A | 7/1921 | Liddell |
| 3,477,151 | A | 11/1969 | Zanella |

(Continued)

FOREIGN PATENT DOCUMENTS

| | | |
|---|---|---|
| DE | 1299675 | 7/1969 |

*Primary Examiner* — Robert E Pezzuto
(74) *Attorney, Agent, or Firm* — Honigman LLP

(57) ABSTRACT

A plow system includes a mounting structure configured to mount at a vehicle, with a center plow pivotally attached at the mounting structure. The center plow is pivoted in a first direction responsive to actuation of a first actuator and is pivoted in a second direction responsive to actuation of a second actuator. A first plow wing is pivotally mounted at a first end of the center plow and a second plow wing is pivotally mounted at a second end of the center plow. Responsive to pivoting of the center plow to a first fully pivoted orientation toward a first side of the vehicle, the first and second plow wings both pivot to a forward orientation. Responsive to pivoting of the center plow to a second fully pivoted orientation toward a second side of the vehicle, the first and second plow wings both pivot to a rearward orientation.

20 Claims, 12 Drawing Sheets

(51) Int. Cl.
*E02F 3/96* (2006.01)
*E01C 19/15* (2006.01)

(56) References Cited

U.S. PATENT DOCUMENTS

| | | | | |
|---|---|---|---|---|
| 4,145,825 | A | 3/1979 | Bertolino | |
| 4,669,205 | A | 6/1987 | Smathers | |
| 5,129,169 | A | 7/1992 | Aubichon | |
| 5,819,444 | A * | 10/1998 | Desmarais | E01H 5/06 37/281 |
| 5,899,007 | A | 5/1999 | Niemela et al. | |
| 6,178,669 | B1 | 1/2001 | Quenzi et al. | |
| 6,393,737 | B2 | 5/2002 | Quenzi et al. | |
| 6,408,549 | B1 | 6/2002 | Quenzi et al. | |
| 6,412,199 | B1 | 7/2002 | Quenzi et al. | |
| 6,442,877 | B1 | 9/2002 | Quenzi et al. | |
| 6,594,924 | B2 | 7/2003 | Curtis | |
| 6,823,615 | B2 | 11/2004 | Strait | |
| 6,928,757 | B2 | 8/2005 | Bloxdorf et al. | |
| 7,107,709 | B2 | 9/2006 | Hamel | |
| 7,134,227 | B2 | 11/2006 | Quenzi et al. | |
| 7,360,327 | B2 | 4/2008 | Osgood et al. | |
| 7,555,853 | B2 | 7/2009 | Paonessa | |
| 7,654,016 | B2 | 2/2010 | Stephan | |
| 7,941,947 | B2 | 5/2011 | Stephan | |
| 7,975,409 | B2 | 7/2011 | Paonessa | |
| 8,776,405 | B2 | 7/2014 | Paonessa | |
| 8,850,724 | B2 * | 10/2014 | Bloxdorf | E01H 5/067 172/815 |
| 8,887,413 | B2 | 11/2014 | Miller | |
| 9,255,370 | B2 | 2/2016 | Paonessa | |
| 2008/0201994 | A1 * | 8/2008 | Crago | E01H 5/06 37/197 |
| 2013/0025629 | A1 | 1/2013 | Vigneault | |
| 2016/0040379 | A1 | 2/2016 | Vigneault | |

* cited by examiner

PLOW ASSEMBLY WITH VALVE SYSTEM FOR WINGS

CROSS REFERENCE TO RELATED APPLICATION

The present application claims the filing benefits of U.S. provisional application Ser. No. 62/289,444, filed Feb. 1, 2016, which is hereby incorporated herein by reference in its entirety.

FIELD OF THE INVENTION

The present invention relates generally to the field of plows that attach to a vehicle, such as a skid steer or pickup truck or the like, and are operable to move snow or other materials.

BACKGROUND OF THE INVENTION

It is known to provide a plow at a vehicle. It is also known to provide adjustable wings at one or both ends of a main plow blade, in order to adjust the length of the plow. Such wings are movably disposed at the ends of the main plow blade and are individually controlled to provide the desired plow configuration. In order to control the wings, additional hydraulic circuits and electronic controls are needed at the plow assembly with corresponding user controls in the vehicle.

SUMMARY OF THE INVENTION

The present invention provides a vehicle attachment or accessory, such as a plow assembly having plow wings that are pivotable between a forward orientation and a rearward orientation, without requiring additional circuits and controls in the vehicle. The plow wings are pivotable responsive to pivotal movement of the center plow to one side or the other, such that an operator of the plow assembly can selectively pivot the plow wings to a desired orientation by fully pivoting the main plow toward one side or the other.

According to an aspect of the present invention, a plow system or assembly comprises a mounting structure configured to mount at a vehicle, and a center plow pivotally attached at the mounting structure and pivotable about a generally vertical axis. The center plow is pivoted in a first direction responsive to actuation of a first actuator and is pivoted in a second direction responsive to actuation of a second actuator (such as via selection by an operator of a first or second pivot function). A first plow wing is pivotally mounted at a first end of the center plow and a second plow wing is pivotally mounted at a second end of the center plow. Responsive to pivoting of the center plow to a first fully pivoted orientation toward a first side of the vehicle, the first and second plow wings both pivot to a forward orientation, and responsive to pivoting of the center plow to a second fully pivoted orientation toward a second or opposite side of the vehicle, the first and second plow wings both pivot to a rearward orientation.

The plow wings may be controlled via a control device that is in fluid communication with the first and second actuators and in fluid communication with plow wing actuators at the first and second plow wings. For example, the control device may comprise a first valve in fluid communication with the first actuator and a first end of the plow wing actuators, and a second valve in fluid communication with the second actuator and a second end of the plow wing actuators, whereby the first valve opens responsive to fluid pressure at the first valve reaching a threshold pressure when the center plow is fully pivoted to the first fully pivoted orientation, and the second valve opens responsive to fluid pressure at the second valve reaching a threshold pressure when the center plow is fully pivoted to the second fully pivoted orientation.

According to another aspect of the present invention, the plow wing assemblies comprise self-contained units that include a mounting plate that is attached at the respective end of the center plow, with the plow wings pivotally attached at the mounting plate. The plow wing assemblies may also include a fixed lower edge element that is fixedly disposed at the mounting plate and provides a forwardly angled wing element for forward angled plowing when the plow wings are pivoted to their rearward orientation.

According to another aspect of the present invention, the plow wings each comprise a base portion pivotally mounted at the end of the center plow and an outer portion that is angled relative to the base portion, whereby the outer portion and the base portion are configured such that, when the plow wing is in the rearward orientation and the center plow is pivoted toward the fully pivoted orientation toward that plow wing's side of the vehicle, the outer portion of that plow wing is generally parallel to the first side of the vehicle.

According to another aspect of the present invention, a pressurized fluid valve system or assembly is operable, responsive to pressurized fluid in actuators of a vehicle attachment or accessory, to pressurize or actuate one or more actuators of another vehicle attachment or accessory. For example, a vehicle attachment or accessory (such as a snow plow or back drag attachment or grapple bucket attachment or asphalt milling machine attachment or the like) is configured to mount at a vehicle and includes a first hydraulic actuator operable or pressurizable to provide a first function (such as raising or pivoting the plow or other attachment), and a second hydraulic actuator operable or pressurizable to provide a second function (such as lowering or pivoting the plow or other attachment). At least one second attachment or accessory (such as a rear plow or back drag attachment or other attachment) is attached or disposed at the vehicle and includes a third actuator operable or pressurizable to provide a third function (such as raising the rear back drag attachment), and a fourth hydraulic actuator operable or pressurizable to provide a fourth function (such as lowering the rear back drag attachment). The valve assembly is in fluid communication between the first and third actuators and between the second and fourth actuators. Responsive to pressure in the fluid line of the first actuator reaching a threshold level (such as when the plow or other attachment is fully raised or pivoted), the valve assembly operates or pressurizes the third actuator to provide the third function (such as pivoting plow wings or raising the back drag attachment or the like). Responsive to pressure in the fluid line of the second actuator reaching a threshold level (such as when the plow or other attachment is fully lowered or pivoted), the valve assembly operates or pressurizes the fourth actuator to provide the fourth function (such as pivoting plow wings or lowering the back drag attachment or the like). The valve assembly is operable responsive to fluid pressure at the respective fluid lines, such that actuation of the third and fourth actuators is achieved without any additional circuitry or controls or inputs or the like. The third and fourth actuators may comprise single acting hydraulic cylinders or may comprise opposite ends of one or more double acting hydraulic cylinders.

These and other objects, advantages, purposes and features of the present invention will become apparent upon review of the following specification in conjunction with the drawings.

DESCRIPTION OF THE PREFERRED EMBODIMENTS

Figure 1:
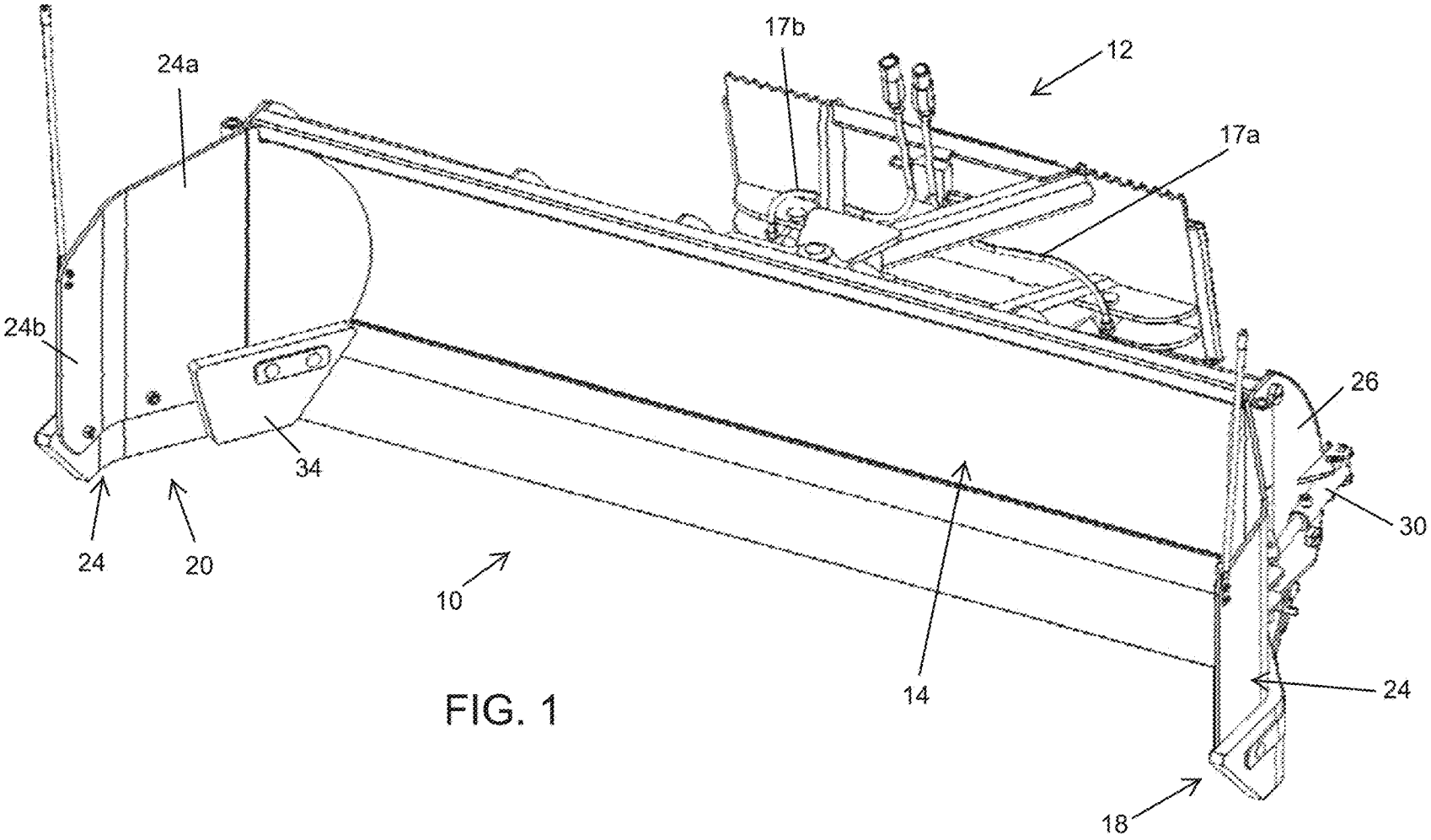
FIG. 1 is a perspective view of a plow assembly in accordance with the present invention, shown with the wings pivoted forward.

Referring now to the drawings and the illustrative embodiments depicted therein, a vehicle attachment or accessory or plow assembly 10 is configured to be mounted to a vehicle (not shown), such as a skid steer or pickup truck or other movable vehicle or construction vehicle or the like, via a support 12, such as an A-frame support or the like (FIG. 1). The plow assembly 10 includes a main or center plow 14 that is pivotally mounted at the support 12 and is pivotable side to side about a generally vertical pivot axis via actuation of a respective one of two actuators 16*a*, 16*b* (such as hydraulic cylinders or the like). Plow assembly 10 includes opposite plow wing assemblies 18, 20 mounted at opposite ends of the center plow 14. Plow assembly 10 also includes a wing pivoting system or actuating system 22, which is operable to pivot the plow wings 24 of the plow assemblies 18, 20 relative to center plow 14 in response to pivoting of the center plow 14 about its pivot axis fully to one side or the other, as discussed below.

Figure 2:
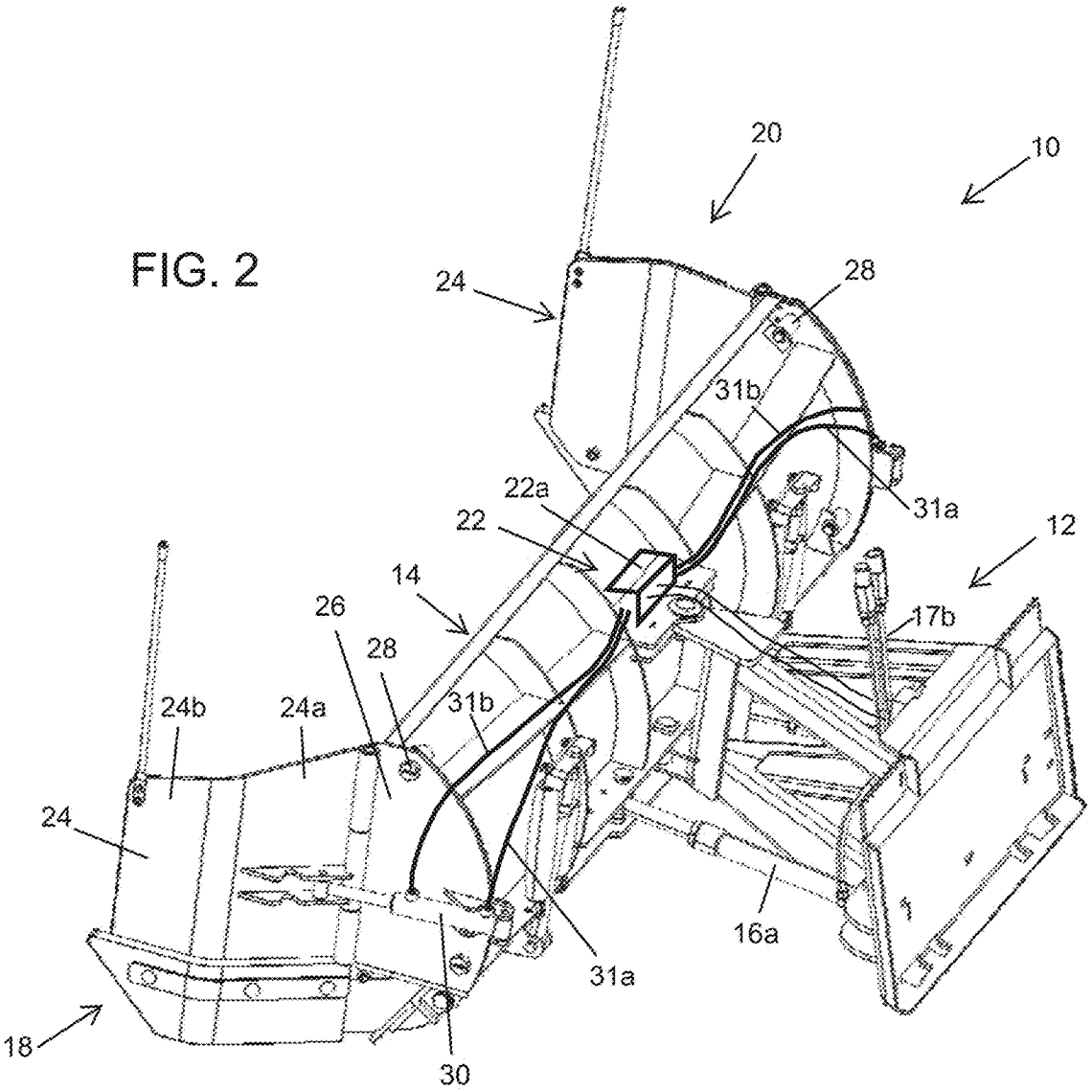
FIG. 2 is a rear perspective view of the plow assembly of FIG. 1.
Figure 3:
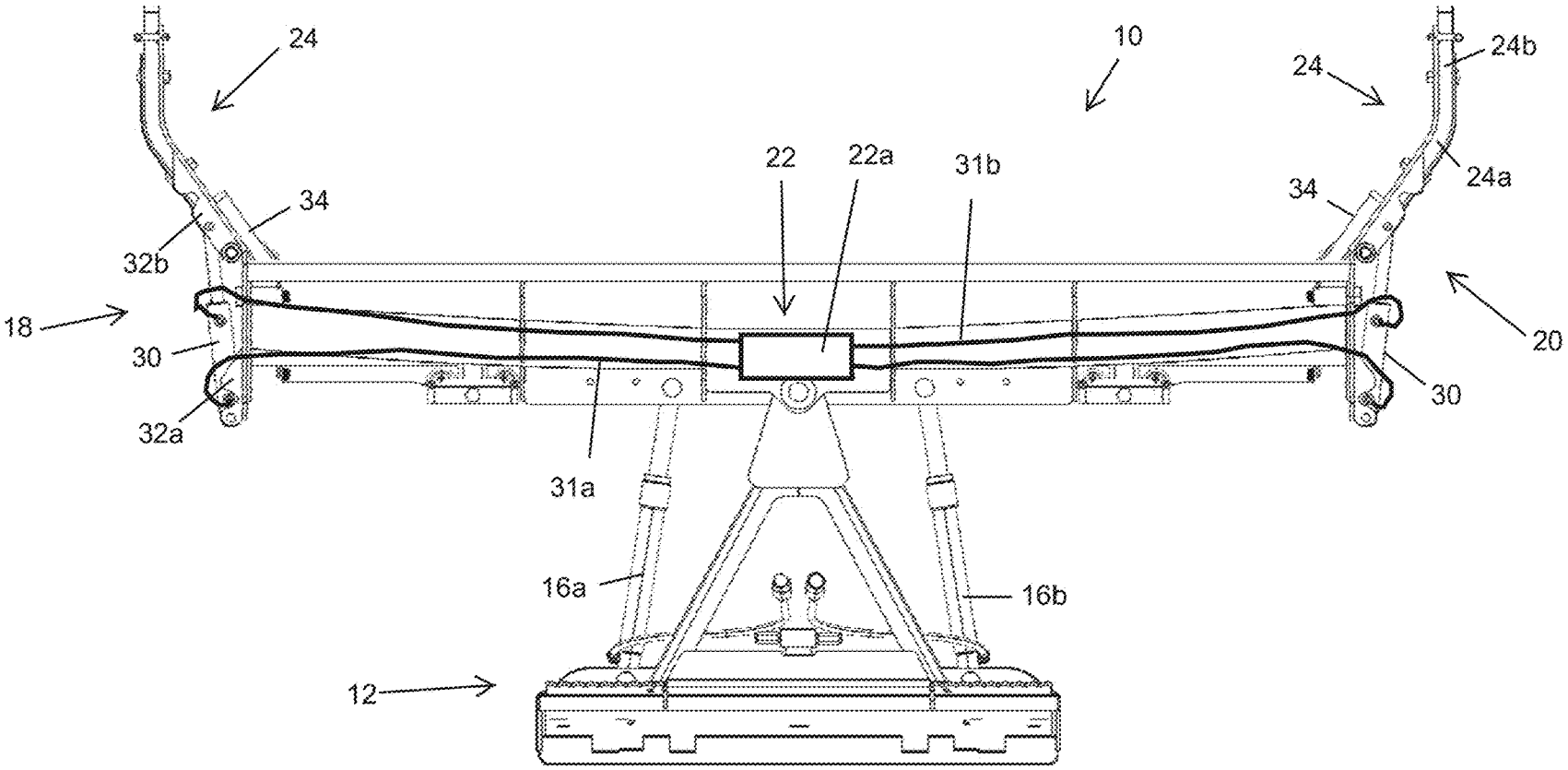
FIG. 3 is a top plan view of the plow assembly of FIG. 1, shown with the plow wings pivoted forward.
Figure 4:
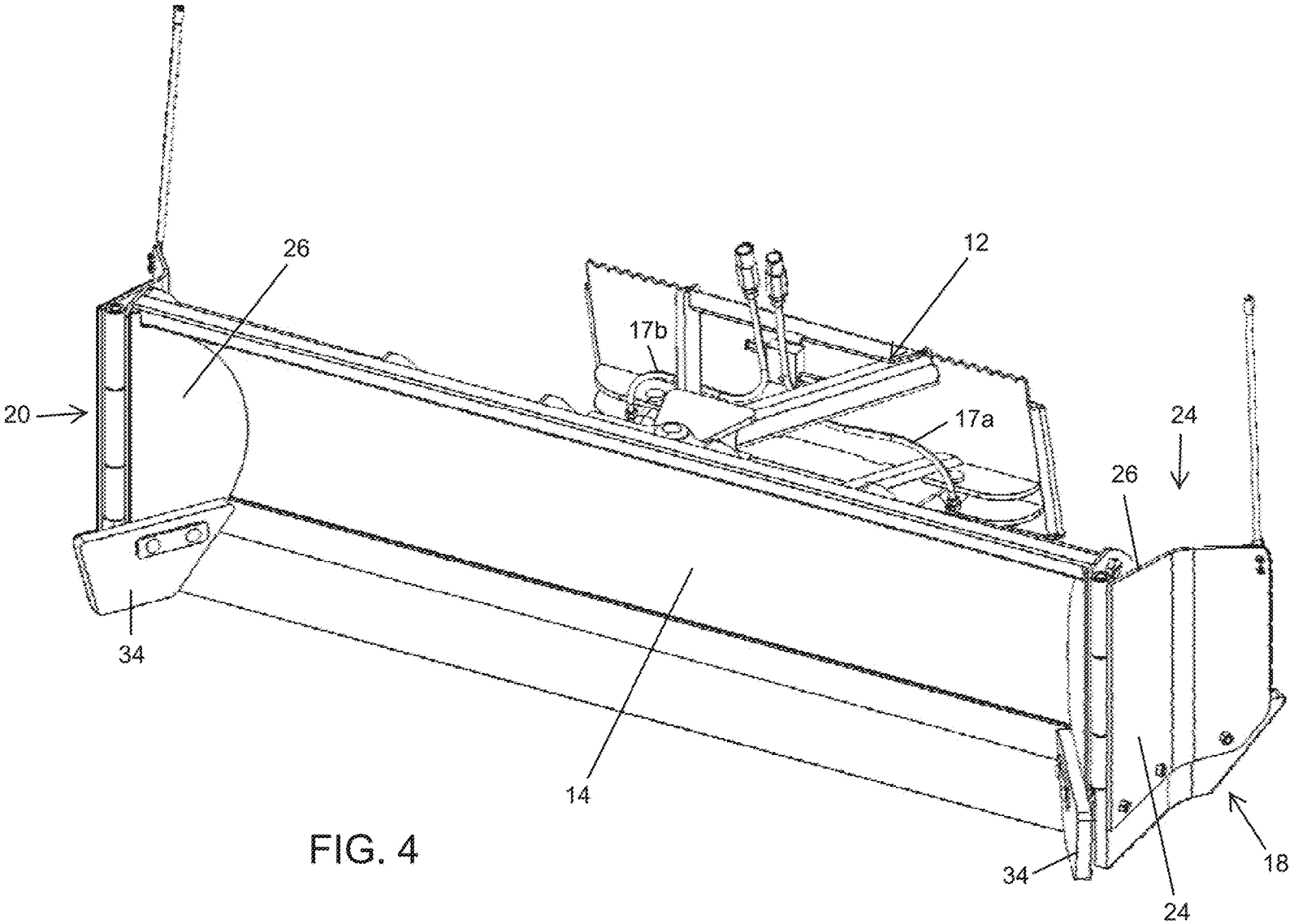
FIG. 4 is another perspective view of the plow assembly of the present invention, shown with the wings pivoted rearward.
Figure 5:
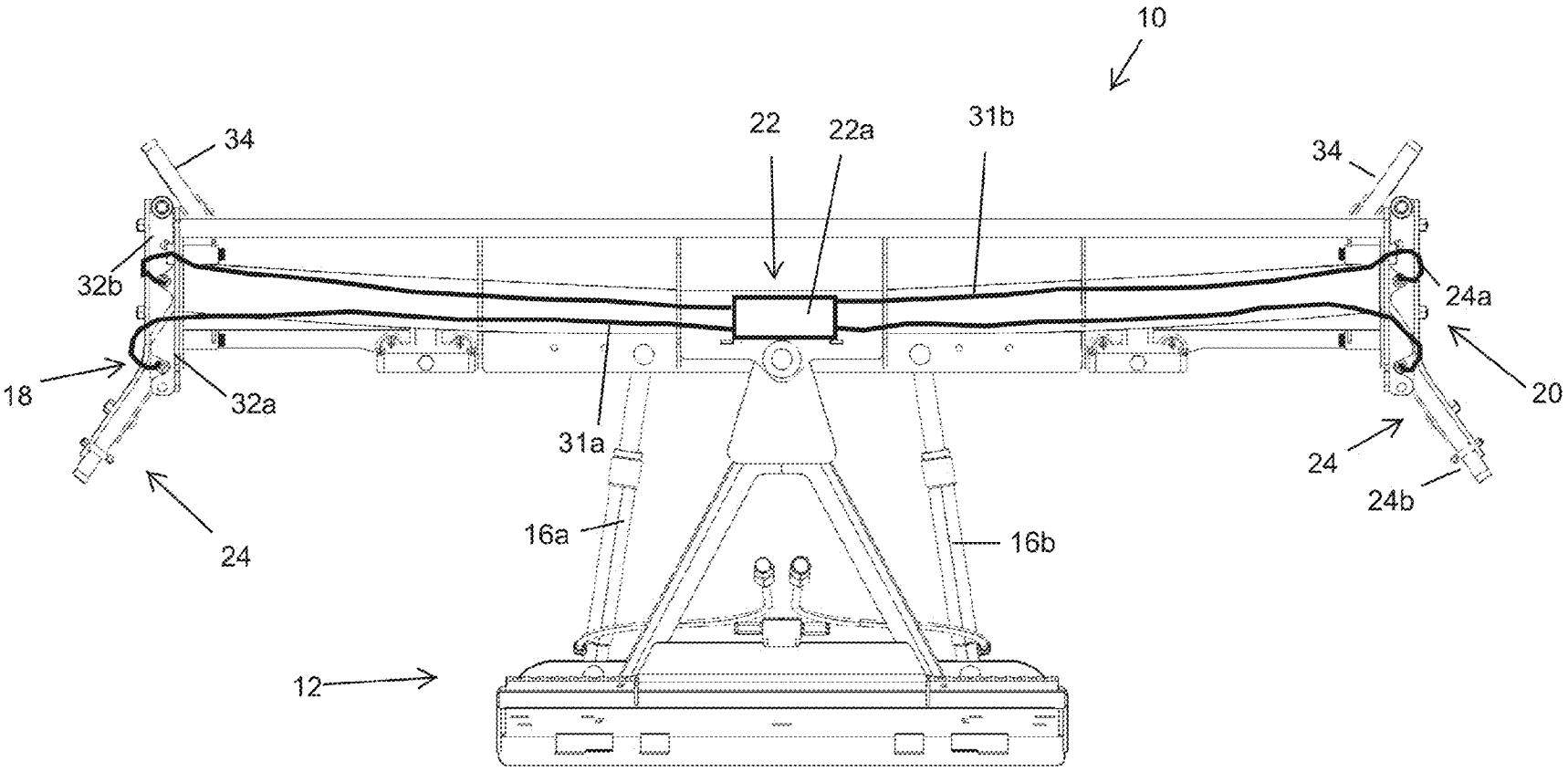
FIG. 5 is a top plan view of the plow assembly of FIG. 1, shown with the plow wings pivoted rearward.
Figure 9:
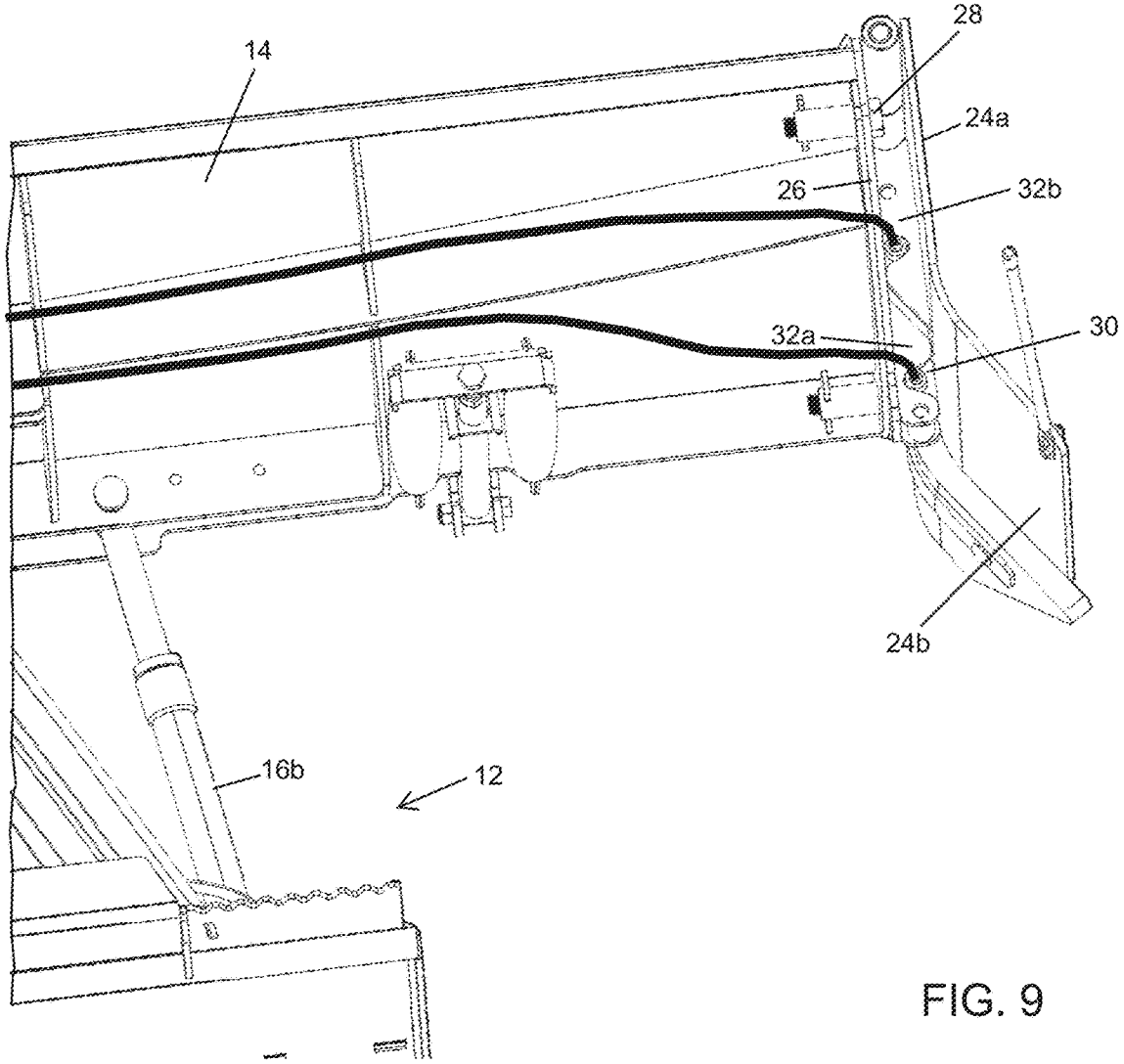
FIG. 9 is another enlarged perspective view of an end of the plow assembly of the present invention, with the wing pivoted rearward.

The plow wing assemblies 18, 20 each include a plow wing 24 that is pivotally attached at a side or end or mounting plate 26, which is configured to be attached at (such as via a plurality of fasteners 28) at the respective end of the center plow 14. The plow assemblies 18, 20 also each include an actuator 30 (such as a dual action hydraulic cylinder or the like) that is pivotally mounted at the mounting plate 26 and at the plow wing 24, whereby extension and retraction of the actuator (such as responsive to pressurized fluid at a respective end of the hydraulic cylinder) causes the plow wing 24 to pivot relative to the mounting plate 26. The actuator 30 is attached at a mounting plate bracket 32*a* (at the mounting plate 26) and a plow wing bracket 32*b* (at the plow wing 24), with the brackets being configured to allow for full pivotal movement of the plow wings between their forward position (FIGS. 1-3) and their rearward position (FIGS. 4 and 5). As best shown in FIGS. 5 and 7-9, the brackets 32*a*, 32*b* include notches or recesses that accommodate the hydraulic fluid line connections at the actuators when the plow wing is substantially or fully extended forward (FIGS. 7 and 8) and substantially or fully retracted (FIG. 9).

Figure 6:
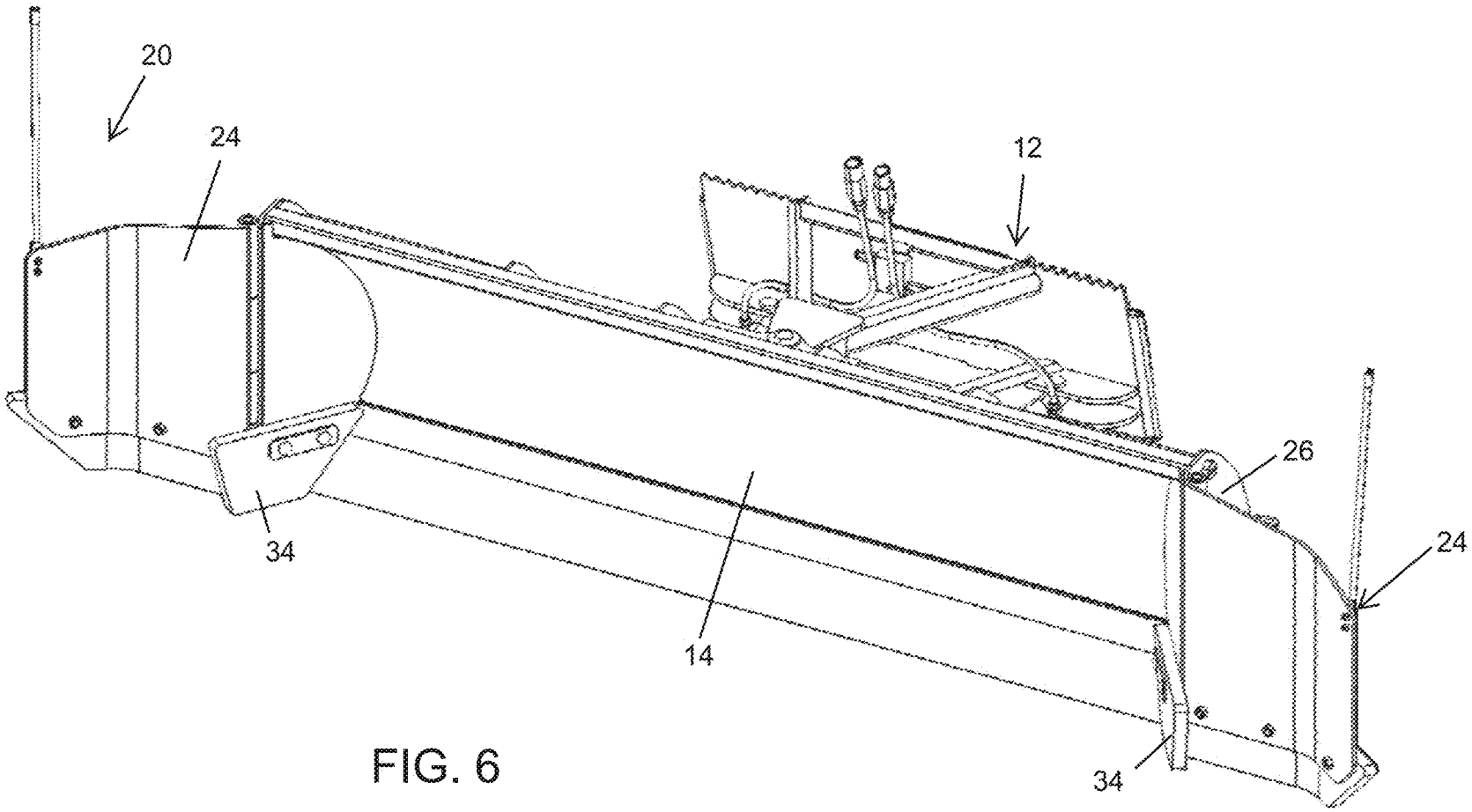
FIG. 6 is another perspective view of the plow assembly of the present invention, shown with the wings pivoted or extended outward.
Figure 7:
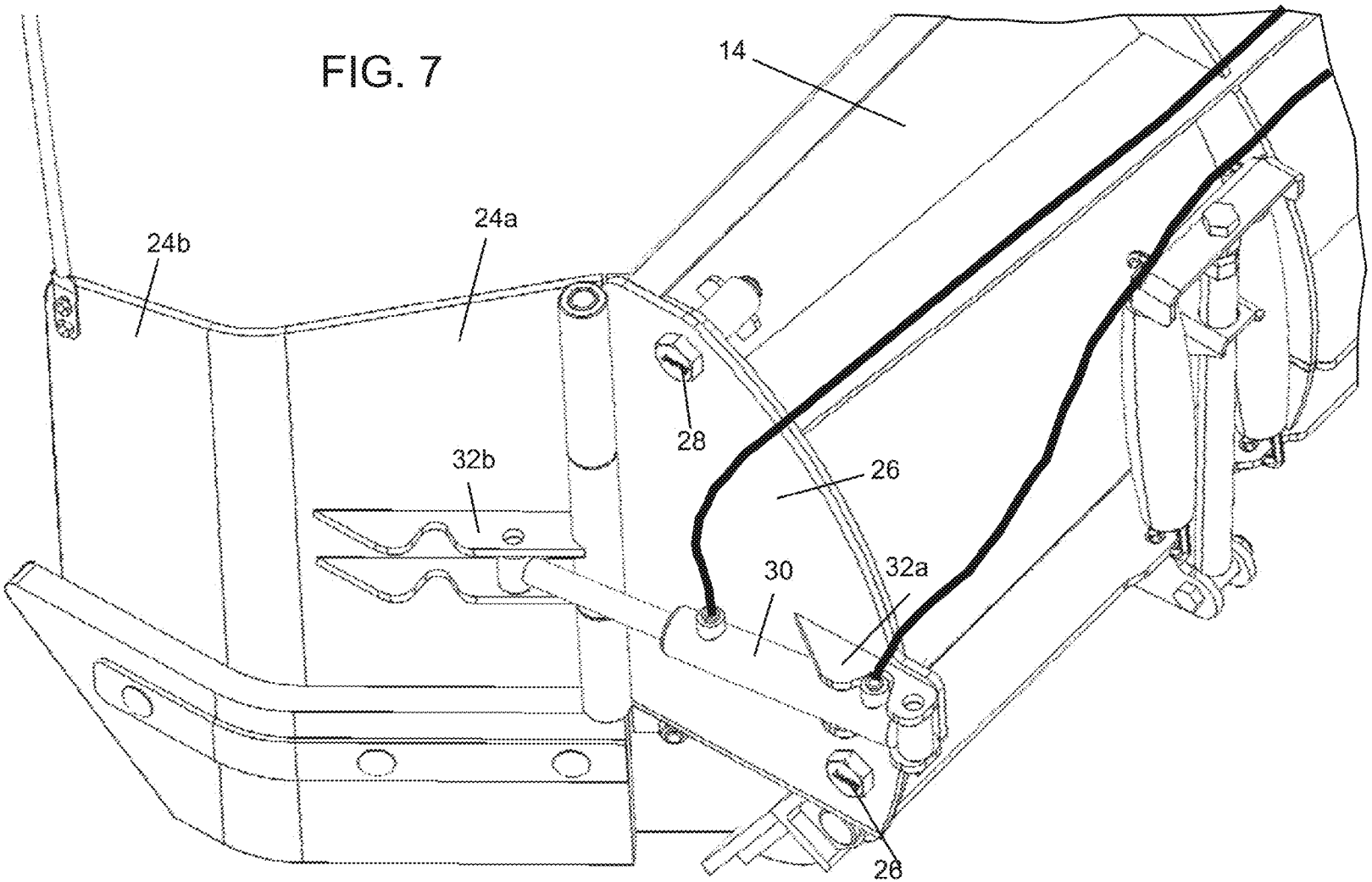
FIG. 7 is an enlarged perspective view of an end of the plow assembly of the present invention, with the wing pivoted forward.
Figure 8:
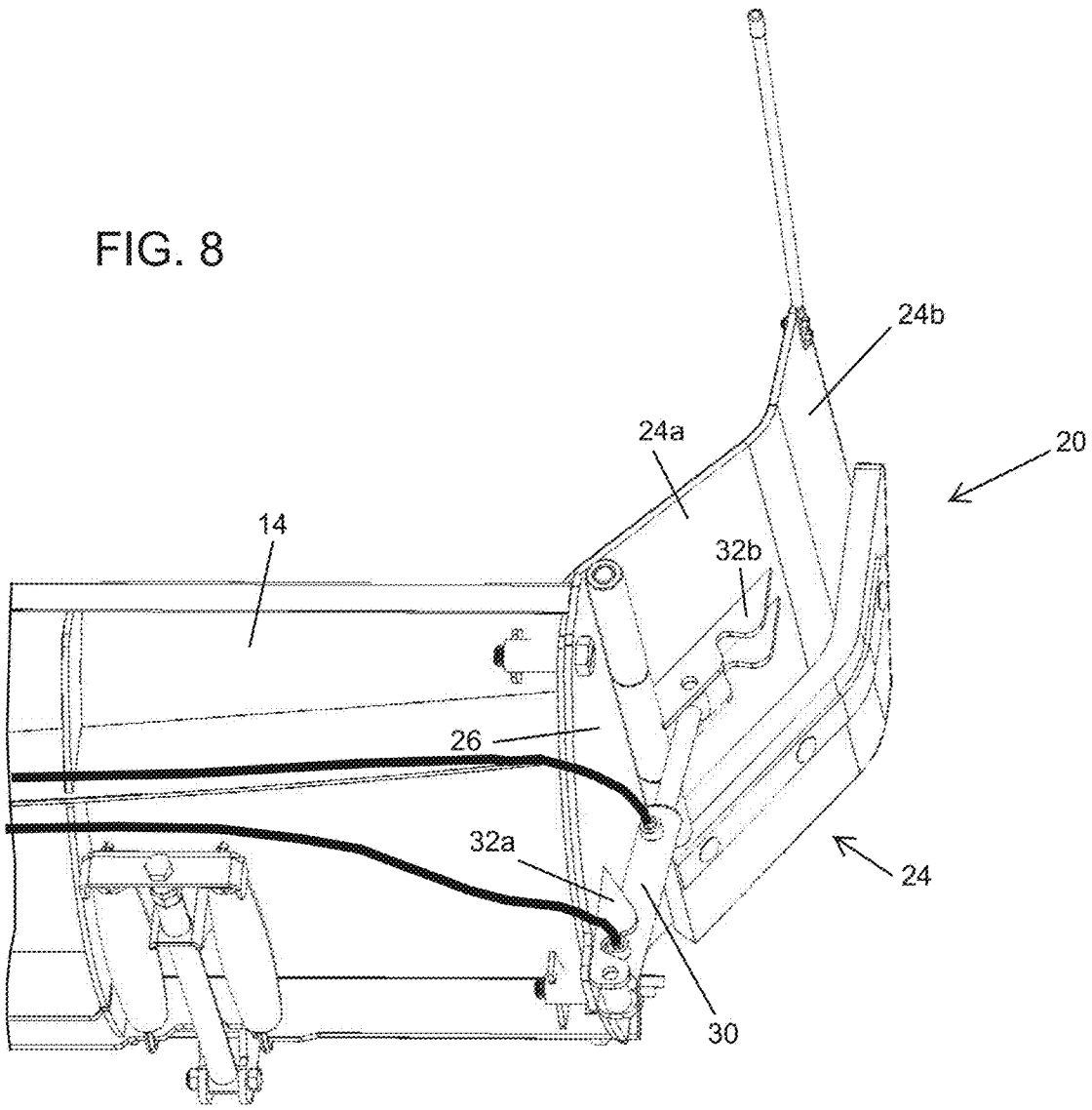
FIG. 8 is another enlarged perspective view of an end of the plow assembly of the present invention, with the wing pivoted forward.

Optionally, and such as shown in FIGS. 1, 4 and 6, the plow wing assemblies 18, 20 include an angled lower edge portion or element 34 that is fixedly attached at the inner surface of the mounting plate 26 and extends forwardly from the mounting plate so as to span the lower part of the pivot joint of the plow wing. As shown in FIG. 1, when the plow wing 24 is pivoted forward, the lower edge element 34 extends along the inner or base portion 24*a* of the plow wing. However, and such as shown in FIGS. 4-6, when the plow wing is pivoted at least partially rearward, the lower edge element 34 extends forward of the pivot joint of the plow wing assembly. The lower edge element 34 may provide a stop for the plow wing when pivoting forward, whereby the base portion 24*a* abuts the lower edge element when the plow wing is in its forward orientation.

Because the filler plates or lower edge elements 34 are fixed at the mounting plates 26 (and optionally may also be bolted or attached to the center plow directly) and thus fixed relative to the center plow 14 when the mounting plate and wing assemblies are mounted at the center plow, the lower edge elements provide a fixed angled wing function at the outer ends of the plow (that is present even when the plow wings are pivoted rearward as shown in FIGS. 4 and 5). The fixed wing function provides enhanced plowing of snow or the like, with the lower edge element limiting flow of snow or materials around a leading end or edge of the plow when the plow wings are pivoted to their rearward orientation and the center plow is angled and used for forward plowing. For example, and with reference to FIG. 11, the lower edge element at the right plow wing (shown in FIG. 11) is at the leading edge or end of the angled center plow and will limit flow of snow or materials around that end of the plow as the plow is moved forwardly through the snow or the like.

Figure 10:
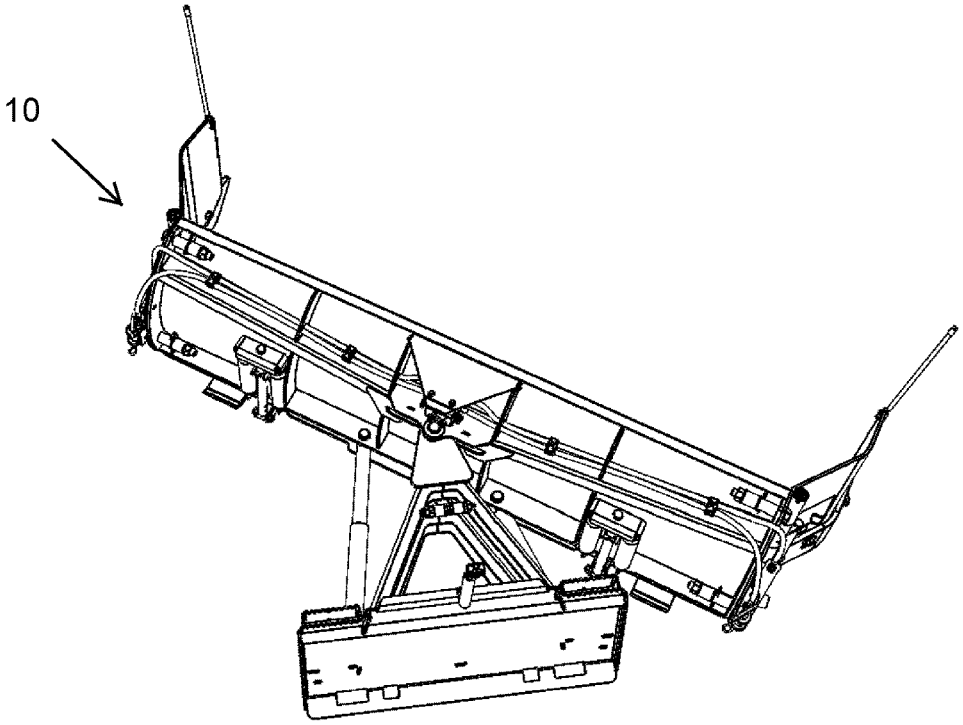
FIG. 10 is a perspective view of the plow assembly pivoted to one side with the plow wings pivoted forward.
Figure 11:
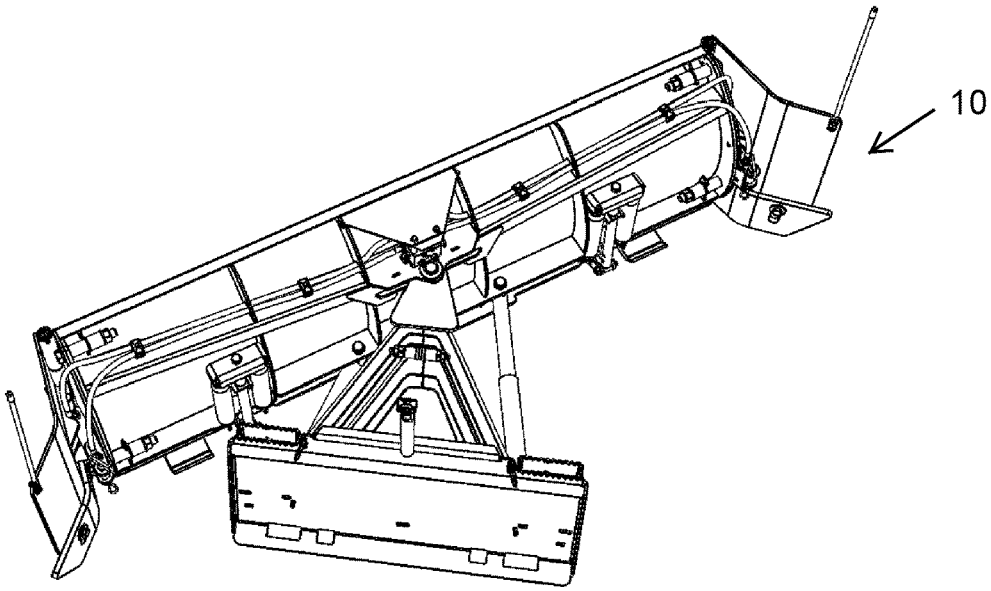
FIG. 11 is a perspective view of the plow assembly pivoted to the other side with the plow wings pivoted rearward.
Figure 12:
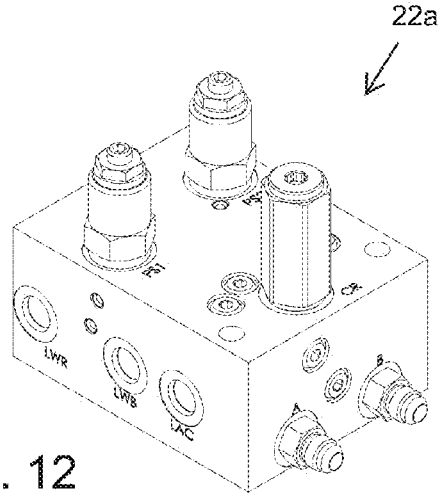
FIG. 12 is a perspective view of the valve assembly of the present invention.
Figure 13:
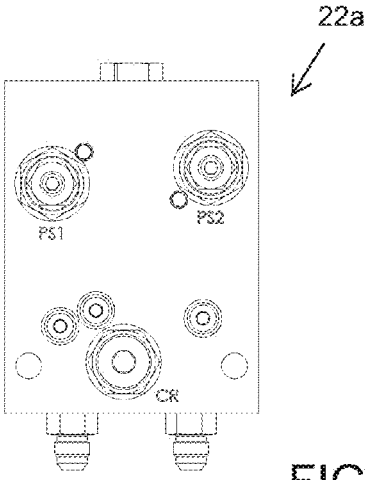
FIG. 13 is a top plan view of the valve assembly of FIG. 12.
Figure 14:
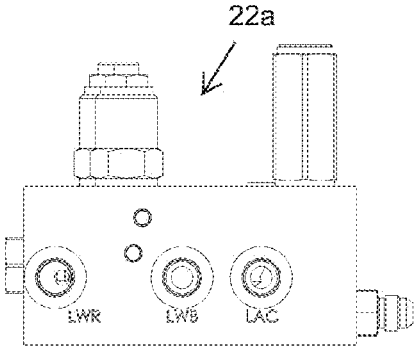
FIGS. 14-17 are side elevations of the valve assembly of FIG. 12.
Figure 15:
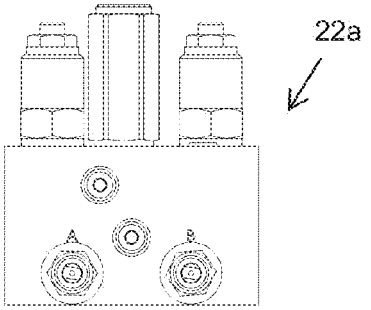
Figure 16:
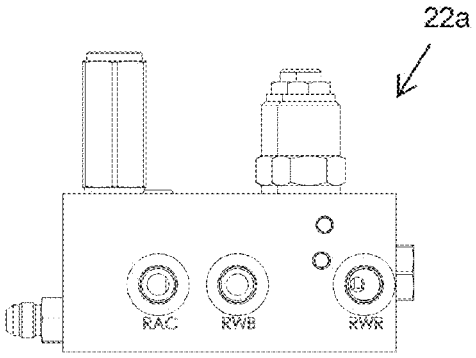
Figure 17:
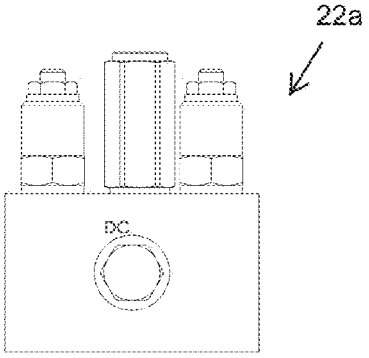

The lower edge elements thus provide for a substantial improvement in the efficiency of the plow when the plow is angled during use (because they limit flow of materials so the operator of the plow does not have to make extra plow passes to clean up such overflow of materials), but not fully angled to the point where the plow wings pivot to the forward or rearward orientation (such as shown in FIGS. 10 and 11 and as discussed below). Thus, even when the wings are retracted to their rearward position (FIGS. 4 and 11), the plow assembly of the present invention provides for enhanced forward plowing due to the fixed presence of the lower edge elements 34 at the ends of the center plow, which provide enhanced angled plowing in the forward direction. Thus, the fixed lower edge elements of the plow wing assemblies allow the plow to cover and clear an area faster than a conventional plow because the angled leading edge of the plow with the angled edge element extending therefrom keeps snow from flowing around the leading end or edge of the angled plow.

The plow wing assemblies 18, 20 thus are self-contained plow wing units that can be added to or mounted to the respective ends of a center plow 14, such that the plow wing assemblies can be added as an aftermarket attachment or optional attachment for the plow assembly. When the plow wing assemblies are attached at the center plow, the actuators 30 are part of the wing pivoting system or actuating system 22, which can be readily connected to the hydraulic system or control system of the plow assembly, whereby the actuators can be actuated (such as responsive to a control unit or user input to the plow assembly) to pivot the plow wings to the desired orientation relative to the center plow.

In the illustrated embodiment, the actuating system 22 comprises a valve or control device 22*a* (FIGS. 2, 3, 5 and 12-18) that is operable to hydraulically actuate the actuators 30 of the plow wing assemblies 18, 20 together or in tandem such that both wings pivot forwardly or rearwardly generally together. The control device 22*a* is connected to two hydraulic supply lines, with each of the supply lines in fluid communication with a control valve or the like that is pressurized responsive to pressurizing a respective one of the main plow pivoting actuators or cylinders 16*a*, 16*b* (the first actuator 16*a* and the second actuator 16*b*) to pivot the center plow in one direction or the other. For example, the supply lines of the control device may be connected to or in fluid communication with the fluid lines 17*a*, 17*b* of the pivot actuators 16*a*, 16*b*. The control device 22*a* includes a sequence valve for each supply line, with an output line or lines of each sequence valve going to a respective end of the cylinders of both actuators 30 of the plow wing assemblies. Thus, responsive to the pressure in a respective supply line at the control device 22*a* exceeding a threshold level, the respective sequence valve opens to provide pressurized fluid to the respective end of the hydraulic cylinders of double acting actuators or cylinders 30 to pivot both of the plow wings (in tandem) forwardly or rearwardly. For example, when the operator selects an input to pivot the center plow to the right (see FIG. 10), such as by pressurizing a support end of the cylinder (such as via the fluid line 17*a*) to extend the first actuator 16*a*, (and optionally by also pressurizing a plow end of the cylinder to retract the second actuator 16*b*, if the actuators are dual action cylinders), the center plow pivots about its vertical axis to the right. When the center plow reaches its full-right position, the pressure builds up in the supply line (since the pressurized fluid is no longer further extending the actuator 16*a*) and, when the pressure at the control device reaches or exceeds the threshold pressure level, the respective sequence valve of the control device 22*a* opens and provides pressurized fluid to the attachment plate end of the actuators 30 (such as via fluid lines 31*a*), which extends the actuators to pivot the plow wings to their forward orientation (and the other sequence valve of the control device may also open to allow for fluid flow back through the valve as the actuator extends). The attachment plate end or port of the actuator 30 may be referred to as the third actuator of the plow and valve system. When the fluid pressure in the supply line drops (such as responsive to the operator actuating the other cylinder to move the plow to its center position), the sequence valve closes and the plow wings remain in the forward position irrespective of the orientation of the center plow.

However, when the operator selects another input to pivot the center plow to the left, such as by pressurizing a support end of the cylinder (such as via a fluid line 17*b*) to extend the second actuator 16*b* (and optionally by also pressurizing a plow end of the cylinder to retract the first actuator 16*a*, if the actuators are dual action cylinders), the center plow pivots about its vertical axis to the left, with the plow wings remaining in their forward orientation. When the center plow reaches its full-left position (see FIG. 11), the pressure builds up in the other supply line of the control device (since the pressurized fluid is no longer further extending the actuator 16*b*) and, when the pressure reaches or exceeds the threshold pressure level, the respective sequence valve of the control device 22*a* opens and provides pressurized fluid to the plow wing end of the actuators 30 (such as via fluid lines 31*b*), which retracts the actuators to pivot the plow wings to their rearward orientation (and the other sequence valve of the control device may also open to allow for fluid flow back through the valve as the actuator retracts). The plow wing end or port of the actuator 30 may be referred to as the fourth actuator of the plow and valve system. When the plow wings are at their retracted or rearward orientation, the sequence valve may close such that the plow wings remain at their retracted or rearward orientation irrespective of the orientation of the center plow.

Figure 18:
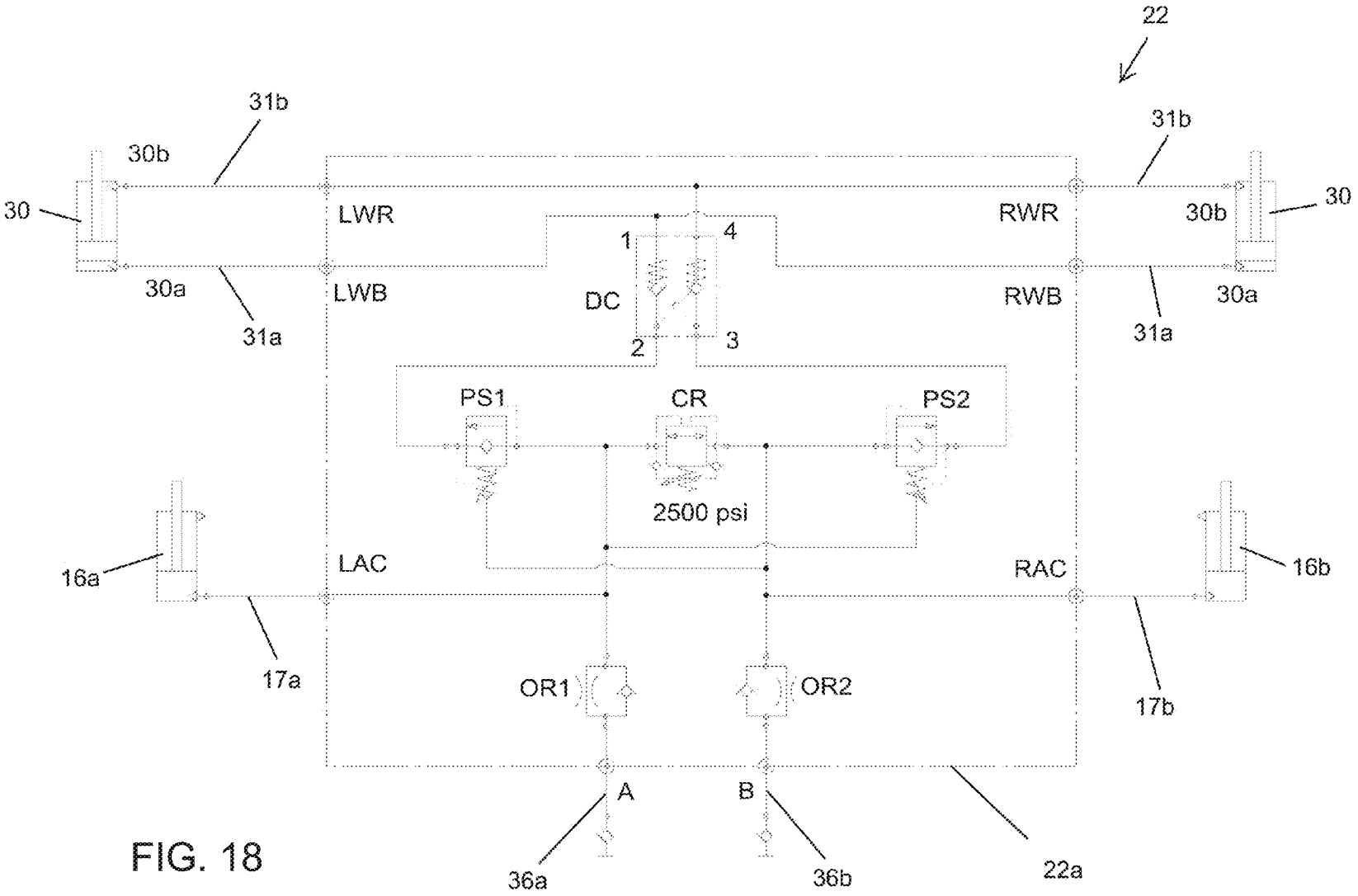
FIG. 18 is a hydraulic schematic of the valve system of the present invention.

In the illustrated embodiment, and such as shown in FIG. 18, the control system 22 and control device or valve assembly 22*a* is connected to supply lines 36*a*, 36*b* (that are pressurized by the vehicle control to pivot the plow to the left or the right) at ports A, B. When fluid line 36*a* is pressurized to extend the left hydraulic cylinder 16*a* (via connection of fluid line 17*a* at port LAC in FIG. 18), the cylinder 16*a* extends until it is at full extension. Then, fluid pressure in line 17*a* increases when the plow pivots to its stop and the operator continues to actuate the plow to pivot in that direction. When the fluid pressure reaches a selected threshold level (such as, for example, 1500 psi), the pressure sequence valve PS1 opens to allow fluid to flow to the directional control valve DC and to the rear ports 30*a* of wing cylinders 30 (via fluid lines 31*a* connected at ports LWB and RWB) to extend cylinders 30 and pivot the wings 24 to the forward position. Fluid that is in cylinders 30 flows (via fluid lines 31*b* connected to ports LWR and RWR) back through the pilot-to-open spring-loaded check valve (which is biased to be open for low pressure flow) of the directional control valve DC (via ports 4 and 3) and back through the pressure sequence valve PS2 and through the check valve of the valve at port B. In situations where there is already higher pressure at lines 31*b* (holding the plow wings in their rearward position), the check valve will open via the pilot connection to the inlet port at 1 of the directional control valve DC, since the increased pressure at the onset of the pressure sequence valve PS1 opening will cause the check valve between ports 3 and 4 to open to allow reverse flow. If the pressure in the lines 36*a* and LAC exceeds an upper threshold level (such as, for example, 2500 psi), the fluid flows through the crossover relief valve CR and back through the check valve of the valve at port B. When the plow wings are pivoted forward and the operator stops pivoting the plow toward that side, the plow wings are maintained in the forward position via cylinders 30 because backflow of the fluid in lines 31*a* is precluded by the spring-loaded check valve at the directional control valve DC (which closes due to the higher pressure in the lines 31*a*).

Similarly, if the operator pivots the plow to the other direction (via pressurizing supply line 36*b* that is connected to the valve assembly at port B), pressurized fluid is supplied to cylinder 16*b* (via the fluid line 17*b* connected at port RAC) to extend the cylinder and pivot the plow toward the left side. When the fluid pressure reaches a selected threshold level (such as, for example, 1500 psi), the pressure sequence valve PS2 opens to allow fluid to flow to the directional control valve DC and to the front ports 30*b* of wing cylinders 30 (via fluid lines 31*b* connected at ports LWR and RWR) to retract cylinders 30 and pivot the wings 24 to the rearward position. Fluid that is in cylinders 30 flows (via fluid lines 31*a* connected to ports LWB and RWB) back through the pilot-to-open spring-loaded check valve (which is biased to be open for low pressure flow) of the directional control valve DC (via ports 1 and 2) and back through the pressure sequence valve PS1 and through the check valve of the valve at port A. In situations where there is already higher pressure at lines 31*a* (holding the plow wings in their forward position), the check valve will open via the pilot connection to the inlet port at 3 of the directional control valve DC, since the increased pressure at the onset of the pressure sequence valve PS2 opening will cause the check valve between ports 1 and 2 to open to allow reverse flow. If the pressure in the lines 36*b* and RAC exceeds an upper threshold level (such as, for example, 2500 psi), the fluid flows through the crossover relief valve CR and back through the check valve of the valve at port A. When the plow wings are pivoted rearward and the operator stops pivoting the plow toward that side, the plow wings are maintained in the rearward position via cylinders 30 because backflow of the fluid in lines 31*b* is precluded by the spring-loaded check valve at the directional control valve DC (which closes due to the higher pressure in the lines 31*b*).

Optionally, the valve device may include adjustable pressure valves, such that an operator or installer of the valve device and plow system may set the threshold pressures for the internal valves. For example, and such as can be seen in FIGS. 12-17, the valve device 22*a* includes an adjustable input or dial for adjusting the pressure at which the pressure sequence valve PS1 opens (e.g., 1,500 psi), and an adjustable input or dial for adjusting the pressure at which the pressure sequence valve PS2 opens (e.g., 1,500 psi), and an adjustable input or dial for adjusting the pressure at which the crossover relief valve opens (e.g., 2,500 psi). The inputs can be rotated to increase or decrease a spring force at the respective valve to correspondingly increase or decrease the pressure at which the valve opens. Optionally, the respective valves may be accessed and removed and replaced via loosening and removal of the respective elements protruding from the control device.

Thus, the plow wings pivot forward or rearward only when the center plow is at its fully rightmost position or fully leftmost position, without requiring any further input from the operator of the plow assembly and vehicle. The plow assembly of the present invention thus provides for pivoting plow wings with only minimal controls (a "right pivot" input and a "left pivot" input) needed in the cab of the vehicle. Although shown as pivoting forward when the center plow pivots to the right side and rearward when the center plow pivots to the left side, clearly, the plow wings may pivot in the opposite direction at the respective rightmost and leftmost orientations of the center plow. Also, although shown as pivoting two wings responsive to pressurizing a respective one of two supply lines, the valve assembly and system of the present invention be operable to pressurize respective ports of any number of double acting cylinders (or ports of single acting cylinders that perform opposite functions, such as one pivoting an accessory in one direction when pressurized and the other pivoting the accessory in the opposite direction when pressurized), while remaining within the spirit and scope of the present invention.

Therefore, the control means or system of the present invention allows the plow assembly to run two hydraulic circuits (with four functions—left/right plow wings forward and left/right plow wings rearward) at a plow assembly that has only one circuit. No additional wiring or controls are required. The operator can operate both of the wings using only the existing hydraulic circuit of the plow assembly (that selectively pivots the center plow to either side). The plow wing system valve thus operates via only one hydraulic circuit on the host vehicle and it does not require any electrical circuitry, harness, solenoids, or controls.

In the illustrated embodiments, the plow wings are curved or bent or formed so that, when pivoted forward, they have a base portion 24*a* that extends forwardly and laterally outwardly and an outer portion 24*b* that extends forwardly from the base portion. Thus, when the plow wings are in their forward orientation, they provide a wider plow with a scoop function that will retain the pushed material (e.g., snow or the like) at the plow during forward pushing of the plow assembly by the vehicle. As can be seen with reference to FIG. 9, when the plow wings are in their rearward orientation, the base portion 24*a* is along (and may abut) the mounting plate 26 at the end of the plow with the outer portion 24*b* extending rearward and laterally outward from the base portion. Because of the angled outer portion of the plow wings, the plow wing configuration of the present invention, when the plow wings are in their retracted or rearward orientation, allows for the plow to be pivoted fully to either side, whereby the outer portion 24*b* would be generally parallel to the side of the vehicle at which the plow is mounted. In such an orientation, the outer portion of the plow wing that is by the side of the vehicle is along and generally parallel to the side of the vehicle and does not risk cutting or gouging the front tire of the vehicle. Thus, the plow wing configuration of the present invention provides for further pivoting of the center plow when the plow wings are retracted, without risk of damage to the vehicle's tires.

The plow assembly of the present invention thus provides pivotable plow wings that can be readily attached at the ends of a center plow as self-contained plow wing units or assemblies. The plow wing actuators may be powered or controlled by a control device that is pressurized via the same pressurized fluid being applied to one of the main plow pivot actuators, thereby reducing or eliminating control inputs for separately controlling the plow wings. Thus, the plow wing assemblies can be readily attached to an existing plow assembly by bolting the plow assemblies at the ends of the center plow and connecting the fluid supply lines to the main plow pivot fluid lines.

The plow wing assembly or system may be attached at an existing plow assembly (comprising a center plow configured for pivotal attachment at a vehicle and two actuators operable to pivot the center plow toward either side of the vehicle) as a kit, whereby, when so attached and with the valve assembly in fluid communication with the actuators of the plow assembly, the plow wings are pivoted responsive to full pivotal movement of the plow blade toward one side or the other. For example, the plow wings and their actuators or cylinders can be bolted or otherwise attached at the ends of a plow and the valve assembly or unit may be mounted at the plow, with fluid lines 31*a*, 31*b* connecting between the valve assembly and the plow wing cylinders. Another set of fluid lines are connected between the valve assembly (at ports LAC and RAC) and the plow pivot actuators or cylinders 16*a*, 16*b*. The main supply lines 36*a*, 36*b* (that may have been connected to the plow pivot cylinders 16*a*, 16*b*) are connected to ports A and B, and the system is then fully functional and ready to operate when the operator of the plow and vehicle actuates a control to pivot the plow toward one side or the other. No other electrical connections or controls or the like are needed to make the valve assembly fully functional.

Thus, a distributor of plow assemblies can stock and provide a universal base plow assembly that can be configured with or without the plow wing system. The plow wing system may be readily mounted to the plow assembly and to different plow assemblies of different widths. Thus, neither the plow manufacturer nor the dealers have to stock a full range of base plows (without plow wings) and a full range of plows with wings. Instead, they need only manufacture and stock a full range of the base plows (at different lengths, such as, for example, a 6 foot length, an 8 foot length and a 10 foot length) and the wing systems (with one SKU number for the wing assemblies/system), which can be installed on any width of the base plow assembly (and which can be ordered or purchased separately to retrofit any existing base plow or wingless plow on a vehicle). Thus, the plow wing system of the present invention provides a wing system that can be readily attached to any base plow either at the time of purchase of the base plow or at a later time to retrofit a base plow (or to replace other wing-type attachments at a center plow).

Optionally, it is envisioned that the plow wing actuators may be controlled by other control means, such as individual solenoids or valves that allow the operator to selectively actuate one or both actuators of the plow assemblies separately from the pivot actuators of the main plow. In such a configuration, the plow wings may be selectively positioned at the forward orientation and rearward orientation irrespective of the pivoting of the center plow. Optionally, with such a configuration and control, the plow wings may be selectively pivoted to and set and held at any position between the forward and rearward positions, such as at a fully extended orientation such as shown in FIG. 6.

Optionally, the valve assembly may operate to provide other features or functions of the plow assembly and/or of another vehicle attachment or vehicle accessory. For example, the valve assembly may operate (responsive to pressure in one or more fluid lines reaching a threshold pressure) adjust a blade pitch (in other words, the angle at which the blade contacts the ground). For example, the system may be configured such that the valve assembly operates an actuator(s) to pivot the main plow upward about a generally horizontal axis when the main plow is fully pivoted to one side and to pivot the main plow downward about the generally horizontal axis when the main plow is fully pivoted to the other side (and this may be done in addition to pivoting the plow wings or instead of pivoting the plow wings, depending on the particular application).

Optionally, the valve assembly may operate to raise and lower a back drag attachment (attached at the rear of the vehicle) or may provide other control of other vehicle attachments. For example, the system may be configured such that the valve assembly operates an actuator(s) to raise a back drag attachment when the front center plow is fully pivoted toward one side and to lower the back drag attachment when the front center plow is fully pivoted toward the other side. Other functions (alone or in combination with one another) may be also or otherwise provided by the valve, such that the valve operates various actuators of the plow assembly or plow wing system or back drag attachment or other vehicle attachment or accessory or the like responsive to pivoting of the center plow fully toward one side or the other (or responsive to other functions achieved by pressurizing one or more hydraulic cylinders of the accessory or attachment).

Optionally, the valve assembly of the present invention may be used in conjunction with various vehicle attachments and may provide additional functions to the attachment (or to another vehicle attachment) responsive to the actuators of the vehicle attachment fully moving or pivoting the vehicle attachment to a stop point (such as when it is fully pivoted to either side of the vehicle or moved to a fully raised or lowered position or the like). For example, the valve assembly or system may be used with a two stage grapple bucket attachment, where activating a single circuit would open the first stage of the grapple to, for example, around 48 inches. If the circuit is held up until the grapple is fully opened to its first stage and dead stops, the valve assembly automatically switches over to a second circuit and to open the second stage of the grapple to, for example, a 72 inch opening (so the grapple can pick up a much larger pile of brush). Optionally, for example, the valve assembly or system may be used with an asphalt milling machine attachment, where activating a single circuit would side shift the milling head to one side or the other. If the circuit is held open until the milling head reaches its full side position and dead stops, the valve automatically switches over two a second valve circuit to move a debris shield into place (so the debris is channeled into a clean windrow for easy pick up). Activating the circuit to pivot or side shift the milling head to the other side would function to actuate the valve to move the debris shield out of place. Optionally, for example, the valve assembly or system may be used with a dozer blade attachment, where activating a single circuit would angle the blade to one side or the other. When the circuit is open and the blade attachment is fully angled to one side and dead stops, the valve will automatically switch over to a second valve circuit and allow the user to adjust the pitch of the blade forward or backwards (which changes the attack angle of the cutting edge in the dirt makes it dig in more or less aggressively). Activating the circuit to pivot or angle the blade to the other side will automatically adjust the pitch of the blade in the other direction.

Thus, the valve assembly of the present invention may be used in conjunction with various vehicle attachments and may provide additional functions to the attachment (or to another vehicle attachment) responsive to the actuators of the vehicle attachment fully moving or pivoting the vehicle attachment to a stop point. When the vehicle attachment reaches one of its stop points (e.g., full right, full left, fully raised, fully lowered or the like), the pressure increases in that respective hydraulic fluid line and, responsive to the pressure in that line reaching a threshold level, the valve assembly opens a valve to provide pressurized fluid to another actuator to provide another function. Similarly, when the vehicle attachment reaches the other of its stop points (e.g., full left, full right, fully lowered, fully raised or the like), the pressure increases in that respective hydraulic fluid line and, responsive to the pressure in that line reaching a threshold level, the valve assembly opens a valve to provide pressurized fluid to another actuator to provide another function. The other or downstream actuators may comprise separate actuators or hydraulic cylinders (where one function is achieved by extending or retracting one actuator and another function is achieved by extending or retracting another actuator), or may comprise opposite ends of a double acting hydraulic cylinder (where one function is achieved by extending the double acting hydraulic cylinder(s) and the other function is achieved by retracting the double acting hydraulic cylinder(s)).

Although shown and described as having two valves for two different functions, it is envisioned that the valve assembly may have three valves (or more), whereby a third valve may be in fluid communication with a cylinder of a third plow actuator (such as a raising/lowering actuator of the plow), such that, when the actuator fully raises the plow, the valve assembly operates to provide a third function (and optionally when the actuator fully lowers the plow, the valve assembly may also (if having four valves) or otherwise operate to provide a fourth function).

Therefore, the present invention provides a plow assembly having a plow wing system comprising plow wing assemblies or units that are attached at the ends of the center plow and pivotable responsive to pivotal movement of the center plow to its full leftmost or full rightmost position, without requiring any additional operator inputs at the vehicle. The plow wing system includes plow wings that are configured to pivot between a forward orientation or position, where the plow wings function to increase the width of the plow and provide a side wall for the plow to limit flowing of material around the ends of the plow during use, and a rearward orientation or position, where the plow wings extend rearward at the ends of the plow to provide an enhanced back plowing function (and an enhanced forward angled plowing function due to the fixed lower edge elements of the plow wing assemblies). The plow wings are configured so that a rearward angled plow wing has its end portion generally parallel to the direction of travel of the vehicle when the plow is pivoted to move that plow wing towards and along the side of the vehicle, thereby limiting damage occurring to the vehicle's tire(s) when the plow is pivoted in that manner.

Changes and modifications in the specifically described embodiments may be carried out without departing from the principles of the present invention, which is intended to be limited only by the scope of the appended claims as interpreted according to the principles of patent law.

The invention claimed is:

1. A vehicular plow system, said vehicular plow system comprising:

a mounting structure configured to mount at a vehicle;

a center plow pivotally attached at said mounting structure and pivotable about a generally vertical axis;

wherein said center plow is pivoted in a first direction responsive to actuation of a first actuator and is pivoted in a second direction responsive to actuation of a second actuator;

a first plow wing pivotally mounted at a first end of said center plow and a second plow wing pivotally mounted at a second end of said center plow;

a control device in communication with said first and second actuators and in communication with a plow wing actuators at each of said first and second plow wings;

wherein, responsive to pivoting of said center plow to a first pivoted orientation toward a first side of the vehicle, said control device controls said plow wing actuators at said first and second plow wings to automatically pivot said first and second plow wings to a forward orientation when said center plow is pivoted to the first pivoted orientation; and wherein, responsive to pivoting of said center plow to a second pivoted orientation toward a second side of the vehicle, said control device controls said plow wing actuators at said first and second plow wings to automatically pivot said first and second plow wings to a rearward orientation when said center plow is pivoted to the second pivoted orientation.

2. The vehicular plow system of claim 1, wherein said first and second plow wings are pivoted to the forward orientation or the rearward orientation responsive to a user selecting a center plow pivot function.

3. The vehicular plow system of claim 1, wherein said control device is in fluid communication with said first and second actuators and in fluid communication with said plow wing actuators at said first and second plow wings.

4. The vehicular plow system of claim 1, wherein, after said control device controls said plow wing actuators at said first and second plow wings to automatically pivot said first and second plow wings to the forward orientation when said center plow is pivoted to the first pivoted orientation, said plow wing actuators maintain said first and second plow wings in the forward orientation until said control device controls said plow wing actuators at said first and second plow wings to automatically pivot said first and second plow wings to the rearward orientation when said center plow is pivoted to the second pivoted orientation.

5. The vehicular plow system of claim 4, wherein, responsive to said center plow pivoting from the first pivoted orientation to the second pivoted orientation, said control device controls said plow wing actuators at said first and second plow wings to automatically pivot said first and second plow wings from the forward orientation to the rearward orientation.

6. The vehicular plow system of claim 1, wherein said first plow wing is pivotally mounted at a first mounting plate that is attached at said first end of said center plow, and wherein said second plow wing is pivotally mounted at a second mounting plate that is attached at said second end of said center plow.

7. The vehicular plow system of claim 6, wherein said first and second plow wings each comprise a lower edge element fixedly disposed at the respective mounting plate, and wherein said lower edge element of each of said first and second plow wings is angled relative to said center plow so as to provide an angled plow edge when said first and second plow wings are pivoted to the rearward orientation.

8. The vehicular plow system of claim 1, wherein said first plow wing comprises a first base portion pivotally mounted at said first end of said center plow and a first outer portion that is angled relative to said first base portion, and wherein said second plow wing comprises a second base portion pivotally mounted at said second end of said center plow and a second outer portion that is angled relative to said second base portion.

9. The vehicular plow system of claim 8, wherein said first outer portion and said first base portion of said first plow wing are configured such that, when said first plow wing is in the rearward orientation and said center plow is pivoted to the first pivoted orientation toward the first side of the vehicle, said first outer portion of said first plow wing is generally parallel to the first side of the vehicle.

10. A plow wing system configured for mounting at a plow assembly, the plow assembly comprising a center plow configured to be pivotally mounted at a vehicle, a first actuator operable to pivot the center plow toward a first side of the vehicle and a second actuator operable to pivot the center plow toward a second side of the vehicle, said plow wing system comprising:

a first plow wing configured to pivotally mount at a first end of the center plow and being pivotable via a first wing actuator;

a second plow wing configured to pivotally mount at a second end of the center plow and being pivotable via a second wing actuator;

a valve assembly configured to be in fluid communication with the first and second actuators of the plow assembly and with said first and second wing actuators;

wherein, with said first and second plow wings pivotally mounted at the center plow and said valve assembly in fluid communication with the first and second actuators of the plow assembly and with said first and second wing actuators, and responsive to pivoting of the center plow to a first fully pivoted orientation toward the first side of the vehicle, said valve assembly operates to actuate said first and second wing actuators to pivot said first and second plow wings to a forward orientation; and wherein, with said first and second plow wings pivotally mounted at the center plow and said valve assembly in fluid communication with the first and second actuators of the plow assembly and with said first and second wing actuators, and responsive to pivoting of the center plow to a second fully pivoted orientation toward the second side of the vehicle, said valve assembly operates to actuate said first and second wing actuators to pivot said first and second plow wings to a rearward orientation.

11. The plow wing system of claim 10, wherein, with said plow wing system mounted at the plow assembly, said valve assembly is in fluid communication with the first and second actuators of the plow assembly.

12. The plow wing system of claim 11, wherein, with said plow wing system mounted at the plow assembly, said valve assembly connects to pressurized fluid supply lines that are selectively pressurized to actuate a respective one of the first and second actuators.

13. The plow wing system of claim 10, wherein, after said valve assembly operates to actuate said first and second wing actuators to pivot said first and second plow wings to the forward orientation responsive to pivoting of the center plow to the first fully pivoted orientation toward the first side of the vehicle, said valve assembly maintains said first and second plow wings in the forward orientation until said valve assembly operates to actuate said first and second wing actuators to pivot said first and second plow wings to the rearward orientation when the center plow is pivoted to the second fully pivoted orientation toward the second side of the vehicle.

14. The plow wing system of claim 13, wherein said valve assembly closes when fluid pressure drops as the center plow is pivoted from the first fully pivoted orientation towards a center orientation to maintain said first and second plow wings in the forward orientation until said valve assembly operates to actuate said first and second plow wing actuators at said first and second plow wings to pivot said first and second plow wings to the rearward orientation when the center plow is pivoted to the second fully pivoted orientation.

15. The plow wing system of claim 13, wherein, responsive to the center plow pivoting from the first fully pivoted orientation to the second fully pivoted orientation, said valve assembly operates said first and second plow wing actuators at said first and second plow wings to pivot said first and second plow wings from the forward orientation to the rearward orientation.

16. A vehicular plow system, said vehicular plow system comprising:

a mounting structure configured to mount at a vehicle;

a center plow pivotally attached at said mounting structure and pivotable about a generally vertical axis;

wherein said center plow is pivoted in a first direction responsive to actuation of a first actuator and is pivoted in a second direction responsive to actuation of a second actuator;

a first plow wing pivotally mounted at a first end of said center plow and a second plow wing pivotally mounted at a second end of said center plow;

wherein, responsive to pivoting of said center plow to a first fully pivoted orientation toward a first side of the vehicle, said first and second plow wings both pivot to a forward orientation;

wherein, responsive to pivoting of said center plow to a second fully pivoted orientation toward a second side of the vehicle, said first and second plow wings both pivot to a rearward orientation;

a control device in fluid communication with said first and second actuators and in fluid communication with a plow wing actuator at each of said first and second plow wings; and wherein said control device comprises a first valve in fluid communication with said first actuator and a first end of each of said plow wing actuators, and a second valve in fluid communication with said second actuator and a second end of each of said plow wing actuators.

17. The vehicular plow system of claim 16, wherein said first valve opens responsive to fluid pressure at said first valve reaching a threshold pressure when said center plow is pivoted to the first fully pivoted orientation, and wherein said second valve opens responsive to fluid pressure at said second valve reaching the threshold pressure when said center plow is pivoted to the second fully pivoted orientation.

18. The vehicular plow system of claim 16, wherein, after said control device controls said plow wing actuators at said first and second plow wings to automatically pivot said first and second plow wings to the forward orientation when said center plow is pivoted to the first fully pivoted orientation, said plow wing actuators maintain said first and second plow wings in the forward orientation until said control device controls said plow wing actuators at said first and second plow wings to automatically pivot said first and second plow wings to the rearward orientation when said center plow is pivoted to the second fully pivoted orientation.

19. The vehicular plow system of claim 18, wherein said first and second valves close when fluid pressure drops as said center plow is pivoted from the first fully pivoted orientation towards a center orientation to maintain said first and second plow wings in the forward orientation until said control device controls said plow wing actuators at said first and second plow wings to automatically pivot said first and second plow wings to the rearward orientation when said center plow is pivoted to the second fully pivoted orientation.

20. The vehicular plow system of claim 18, wherein, responsive to said center plow pivoting from the first fully pivoted orientation to the second fully pivoted orientation, said control device controls said plow wing actuators at said first and second plow wings to automatically pivot said first and second plow wings from the forward orientation to the rearward orientation.

* * * * *